US007047773B1

(12) United States Patent
Lin

(10) Patent No.: US 7,047,773 B1
(45) Date of Patent: May 23, 2006

(54) COMBINATION LOCK AND PADLOCK COMBINATION

(76) Inventor: Fu Chuan Lin, No. 3, Lane 88, Sec. 1, Jhongsing Rd., Wugu Township, Taipei County (TW)

( * ) Notice: Subject to any disclaimer, the term of this patent is extended or adjusted under 35 U.S.C. 154(b) by 0 days.

(21) Appl. No.: 11/147,095

(22) Filed: Jun. 7, 2005

(51) Int. Cl.
*E05B 37/10* (2006.01)

(52) U.S. Cl. ..... 70/25; 70/432; 70/330

(58) Field of Classification Search ..... 70/25, 70/21, 319, 284, DIG. 71, 22–24, 26–49, 70/285, DIG. 63, 304, 308, 309, 311, 312
See application file for complete search history.

(56) References Cited

U.S. PATENT DOCUMENTS 4,098,100 A * 7/1978 Wah ..... 70/38 A
4,351,171 A * 9/1982 Tsui ..... 70/339
5,042,277 A * 8/1991 Jenn-Rong ..... 70/28
5,587,702 A * 12/1996 Chadfield ..... 340/542
5,931,030 A * 8/1999 Chen ..... 70/38 A
6,708,534 B1 * 3/2004 Ruan ..... 70/38 A
6,729,166 B1 * 5/2004 Lai ..... 70/25
6,843,080 B1 * 1/2005 Yu ..... 70/21
6,877,345 B1 * 4/2005 Misner et al. ..... 70/25
2005/0039501 A1 * 2/2005 Yu ..... 70/29
2005/0044901 A1 * 3/2005 Yu ..... 70/25
2005/0262903 A1 * 12/2005 Ling et al. ..... 70/21

* cited by examiner

*Primary Examiner*—Brian E. Glessner
*Assistant Examiner*—William Schrode
(74) *Attorney, Agent, or Firm*—Pro-Techtor Int'l Services

(57) ABSTRACT

Provided is a combination lock and padlock combination comprising a housing include a window; a tumbler wheel assembly; a cylindrical moveable bar inserted through the tumbler wheels; a locking mechanism including a U-shaped member fixed at the bar, a rectangular shuttle member having a central opening, a projection at one side, a spring biased extension at the other side inserted through the shuttle member, and an arcuate recess at an end of the extension, and a parallelepiped indicator assembly fitted in a cavity proximate a shackle receiving hole and including a latch, an internal spring having one end urged against a wall of the cavity, and an indicating face on its top; a U-shaped shackle having an annular groove proximate one end being in contact with the recess; and a cylindrical key turning assembly co-acted with the shuttle member.

1 Claim, 9 Drawing Sheets

COMBINATION LOCK AND PADLOCK COMBINATION

BACKGROUND OF THE INVENTION

1. Field of Invention

The present invention relates to combination locks and more particularly to a combination lock capable of being opened by inserting a key into keyhole in addition to turning tumbler wheels to a set series of numbers for opening.

2. Related Art

Locks with features of both pad lock and combination lock are well know. Conventionally, in a key opening operation of the lock a person has to turn a key inserted into a keyhole with one hand and pull a shackle out of a housing for opening with the other hand. This is inconvenient especially when only one hand is available. Also, there is a need of providing means on a combination lock and padlock combination for informing other persons (e.g., customs officer) that a luggage, a container or the like being locked by the combination lock and padlock combination has been opened previously for inspection so that a further opening of the same is not necessary. However, such feature has not been available in prior combination lock and padlock combinations as far as the present invention is aware. Thus, the need for improvement still exists.

SUMMARY OF THE INVENTION

It is therefore an object of the present invention to provide a combination lock and padlock combination as a lock comprising a housing comprising a cover including a window proximate edge and a plurality of wheel openings, and a base including a first shackle receiving hole, a second shackle receiving hole parallel and opposing the first shackle receiving hole, and a cavity proximate the second shackle receiving hole; a tumbler wheel assembly disposed in the base and comprising a plurality of tumbler wheels each partially projected from the wheel opening and having a plurality of slots along its inner surface, a cylindrical moveable bar inserted through the tumbler wheels, the bar including a forward extension, and a plurality of lengthwise locking fins on its surface, the locking fins being aligned, snugly fitted in the slots and interlocked engaged therewith; a locking mechanism disposed in the base and comprising a U-shaped member fixedly connected to the forward extension of the bar, the U-shaped member including two rectangular channels on both sides, a rectangular shuttle member including a central opening, a projection at one side, a spring biased extension at the other side, the extension being inserted through the channels until being stopped by a shoulder between itself and the shuttle member with the spring of the extension being biased between both sides of the U-shaped member, and an arcuate recess formed at an end of the extension, and a parallelepiped indicator assembly fitted in the cavity and including a latch at one side proximate the projection, an internal spring having one end urged against a wall of the cavity, and a knurled indicating face on its top; a U-shaped shackle comprising one leg received in the second shackle receiving hole in a locked position, the other leg having an annular groove proximate a terminating end thereof and received in the first shackle receiving hole, the groove being in contact with the recess, and a spring depressible detent being pressed into the housing in a locked position; and a cylindrical key turning assembly disposed in the base and comprising a rectangular side ridge, a keyhole, and a forward bar-shaped protrusion having half of its forward portion being cut, the forward portion of the protrusion inserted through the central opening until a shoulder between itself and a rear portion thereof is stopped, whereby turning the tumbler wheels will turn the locking fins until a correct combination is shown on the wheel openings wherein the bar moves forward to push the U-shaped member and the shuttle member forward, and the groove moves toward a mouth of the first shackle receiving hole until being stopped with a terminating end of one leg cleared the second shackle receiving hole such that turning one leg about the other leg will open the lock; inserting a key into the keyhole to clockwise turn the key turning assembly about 180 degrees will move the shuttle member leftward for causing the projection to press and flatten the latch with the recess cleared the groove and the spring expanded to push the indicator assembly until being stopped such that pulling the shackle upward until the other leg is stopped will cause the terminating end of one leg to clear the second shackle receiving hole and pivoting one leg about the other leg will open the lock; continuously turning the tumbler wheels until the tumbler wheels has turned to a second combination such that turning one leg about the other leg about 180 degrees, pressing the shackle to move the groove along the first shackle receiving hole and move the bar toward a bottom of the housing for disengaging the locking fins from the slots and enabling a selection of the second combination to represent the combination for opening the lock, and pulling the shackle upward to engage the locking fins with the slots different from before; and inserting a master key into the keyhole to clockwise turn the key turning assembly about 180 degrees will move the shuttle member leftward for causing the projection to press and flatten the latch with the recess cleared the groove and the spring expanded to push the indicator assembly until being stopped such that pulling the shackle upward until the other leg is stopped will cause the terminating end of one leg to clear the second shackle receiving hole, pivoting one leg about the other leg will open the lock with the indicating face aligned with the window, counterclockwise turning the key turning assembly about 180 degrees will move the shuttle member rightward for disengaging the projection from the latch and engaging the recess with the groove, pushing the shackle downward until the other leg is stopped with the terminating end of one leg received in the second shackle receiving hole and the lock locked wherein the indicating face aligned with the window is maintained so as to indicate that the lock has been opened previously by viewing the indicating face through the window.

The above and other objects, features and advantages of the present invention will become apparent from the following detailed description taken with the accompanying drawings.

DETAILED DESCRIPTION OF THE INVENTION

Figure 1:
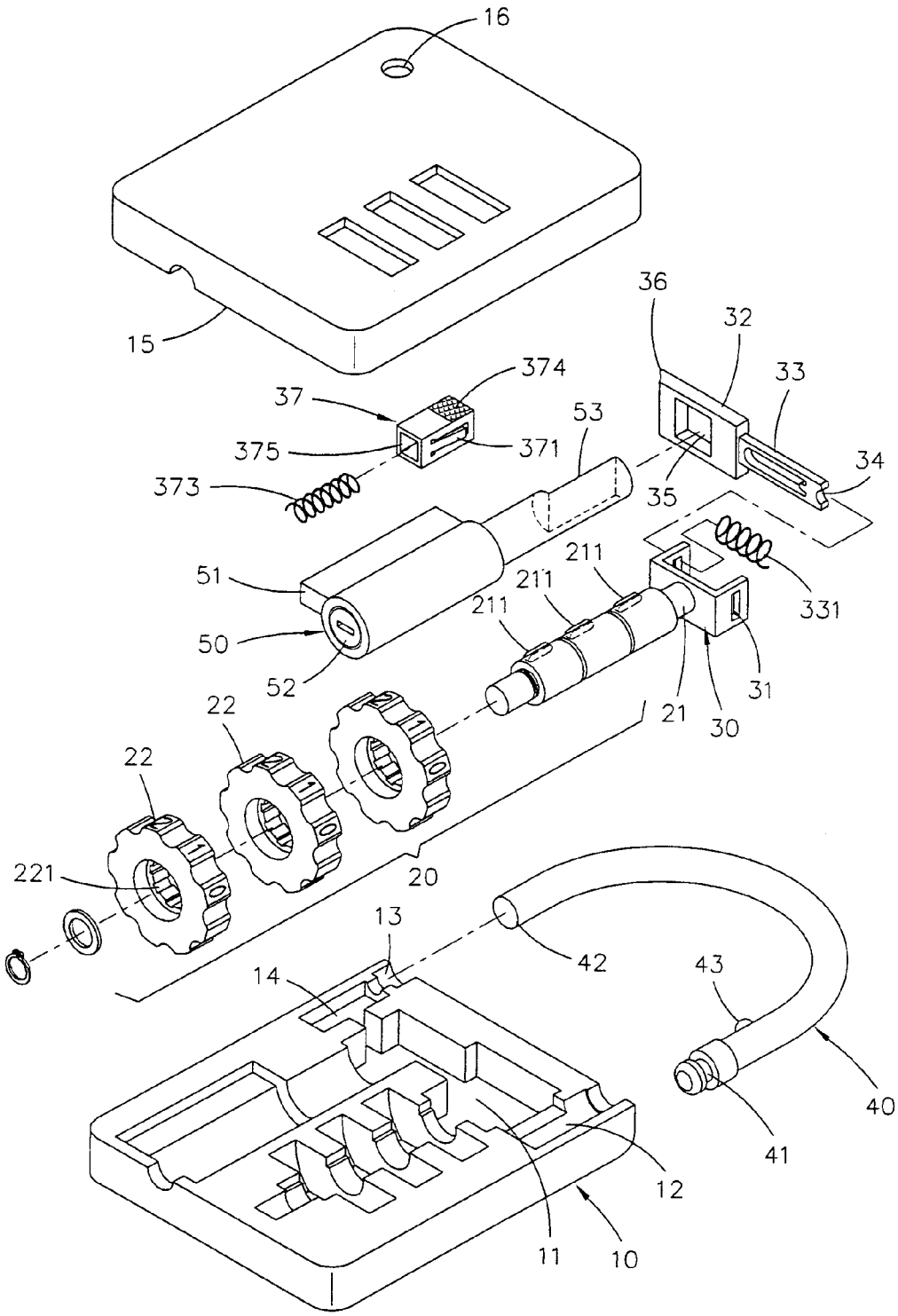
FIG. 1 is an exploded view of a preferred embodiment of combination lock and padlock combination according to the invention.
Figure 2:
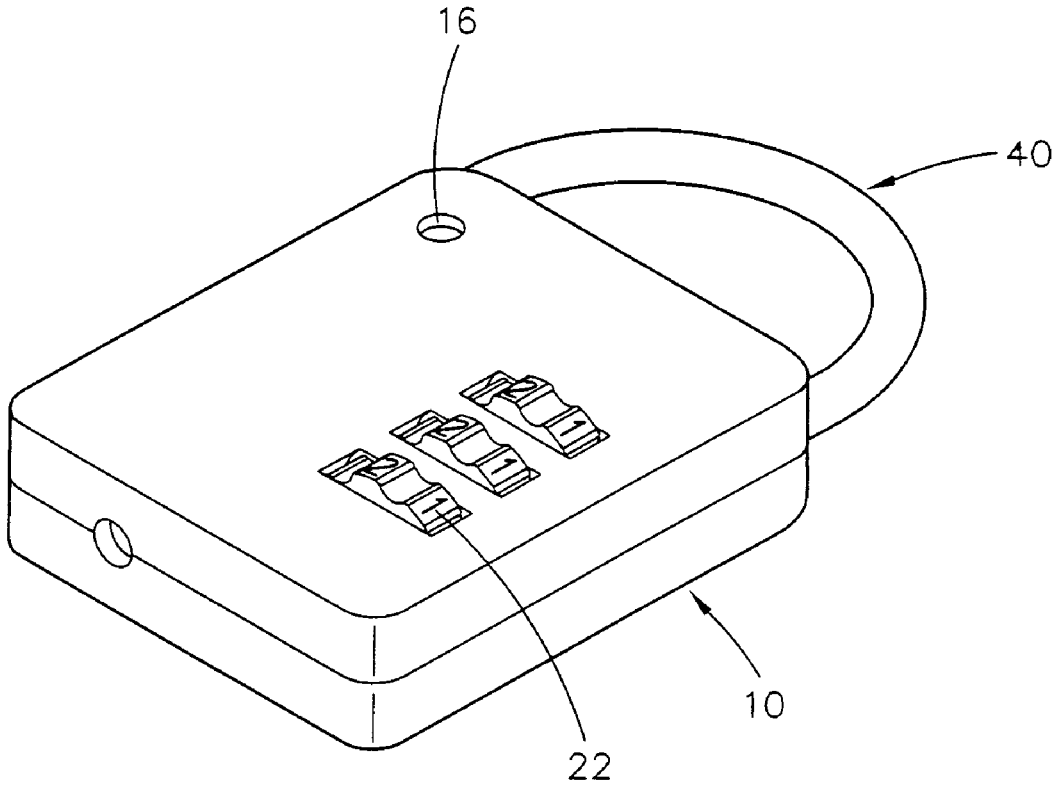
FIG. 2 is a perspective view of the assembled combination lock and padlock combination in FIG. 1.
Figure 3:
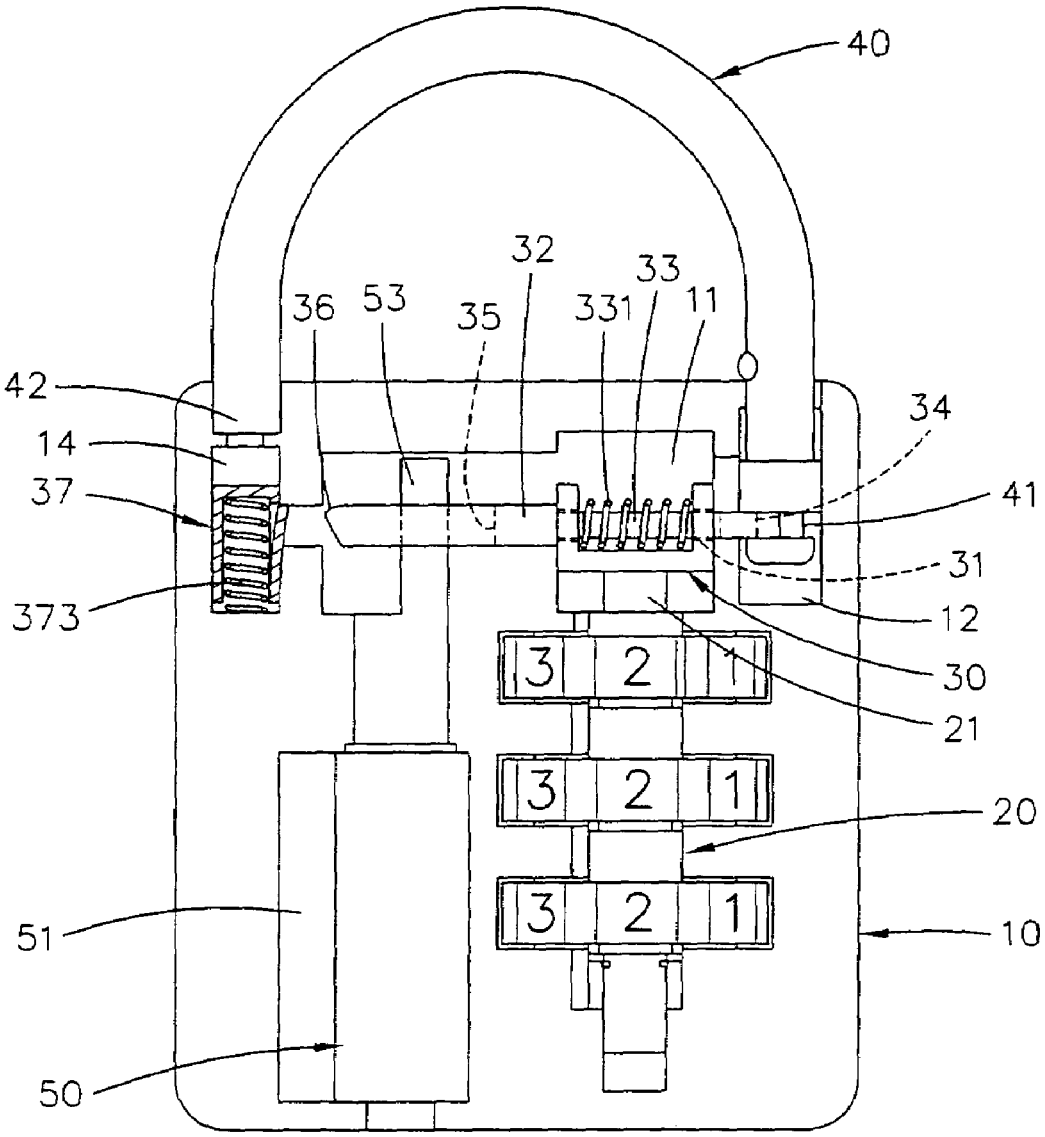
FIG. 3 is a top plan view of the combination lock and padlock combination with cover removed and the combination lock and padlock combination in its locked position.

Referring to FIGS. 1, 2, and 3, a combination lock and padlock combination (i.e., lock) constructed in accordance with the invention is shown and comprises a housing 10, a tumbler wheel assembly 20, a locking mechanism 30, a U-shaped shackle 40, and a key turning assembly 50. Each component will be described in detail below.

The parallelepiped housing 10 comprises a cover 15 having an window 16 proximate one of its four corners, and a base including a first hole 12 proximate one of its four corners, a second hole 13 proximate the other corner opposing the first hole 12, a cavity 14 proximate the second hole 13, and an internal space 11 between the first hole 12 and the cavity 14.

The tumbler wheel assembly 20 is anchored in a series of half-circular recesses on the base of the housing 10 in communication with each other and comprises three tumbler wheels 22 each having a plurality of slots 221 along its inner surface, a cylindrical moveable bar 21 fitted in the tumbler wheels 22, the bar 21 including a plurality of sections each having a lengthwise locking fin 211 on its surface, the locking fins 211 being aligned and snugly fitted in the slots 221.

The locking mechanism 30 comprises a first section fitted in the space 11 including a U-shaped member fixedly connected to a forward extension of the bar 21, the U-shaped member including two rectangular channels 31 on both sides, a rectangular shuttle member 32 including a central opening 35, a projection 36 at one side, a rectangular extension 33 at the other side, the extension 33 being inserted through the channels 31 until being stopped by a shoulder between itself and the shuttle member 32, the extension 33 including a first spring 331 put thereon, the first spring 331 being biased between two sides of the U-shaped member, an arcuate recess 34 formed at an end of the extension 33, and a second section implemented as a parallelepiped indicator assembly 37 fitted in the cavity 14 and including a latch 371 at one side spaced from the projection 36 by a short distance, an internal space 375, a second spring 373 anchored in the space 375 wherein the second spring 373 is compressed in a locked position, and a knurled indicating face 374 on its top.

The shackle 40 comprises one leg with a terminating end 42 received in the second hole 13 in a locked position, an annular groove 41 proximate a terminating end of the other leg received in the first hole 12, the groove 41 being in contact with the recess 34, and a spring depressible detent 43 being pressed into the housing 10 in a locked position. The cylindrical key turning assembly 50 is disposed in a cavity of the base and comprises a rectangular side ridge 51, a keyhole 52, and a forward bar-shaped protrusion 53 having half of its forward portion being cut, the forward portion of the protrusion 53 inserted through the opening 35 until a shoulder between itself and a rear portion thereof is stopped at the mouth of the opening 35. An end of the forward portion of the protrusion 53 is proximate a wall of the space 11.

Figure 4:
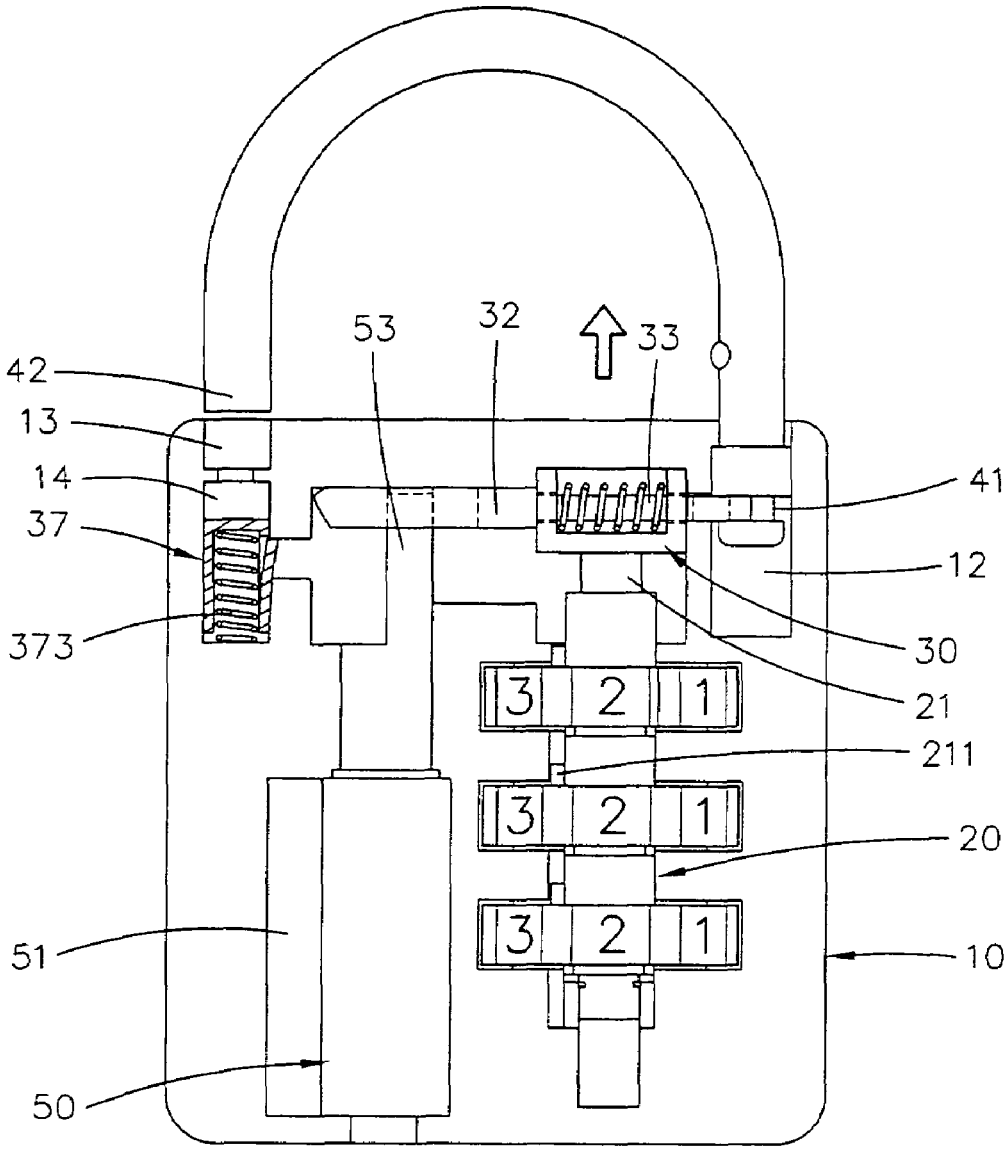
FIG. 4 is a view similar to FIG. 3, where the lock is opened by turning tumbler wheels to a set series of numbers.

Referring to FIG. 4 in conjunction with FIG. 3, an unlocking operation of the invention will now be described in detail below. In a normal case a person can turn the tumbler wheels 22 with the locking fins 211 turned the same due to an interlocked engagement with the slots 221. This turning will continue until the correct set series of numbers (i.e., combination) are shown on openings of the cover 15. At this moment, the bar 21 moves forward to push the U-shaped member and thus the shuttle member 32 forward. As a result, the groove 41, caused by the recess 34, moves toward an opening of the first hole 12 until being stopped by a wall in the housing 10. At this moment, the terminating end 42 of one leg clears the second hole 13. Finally, turn one leg of the shackle 40 about its other leg for opening the lock.

Figure 5:
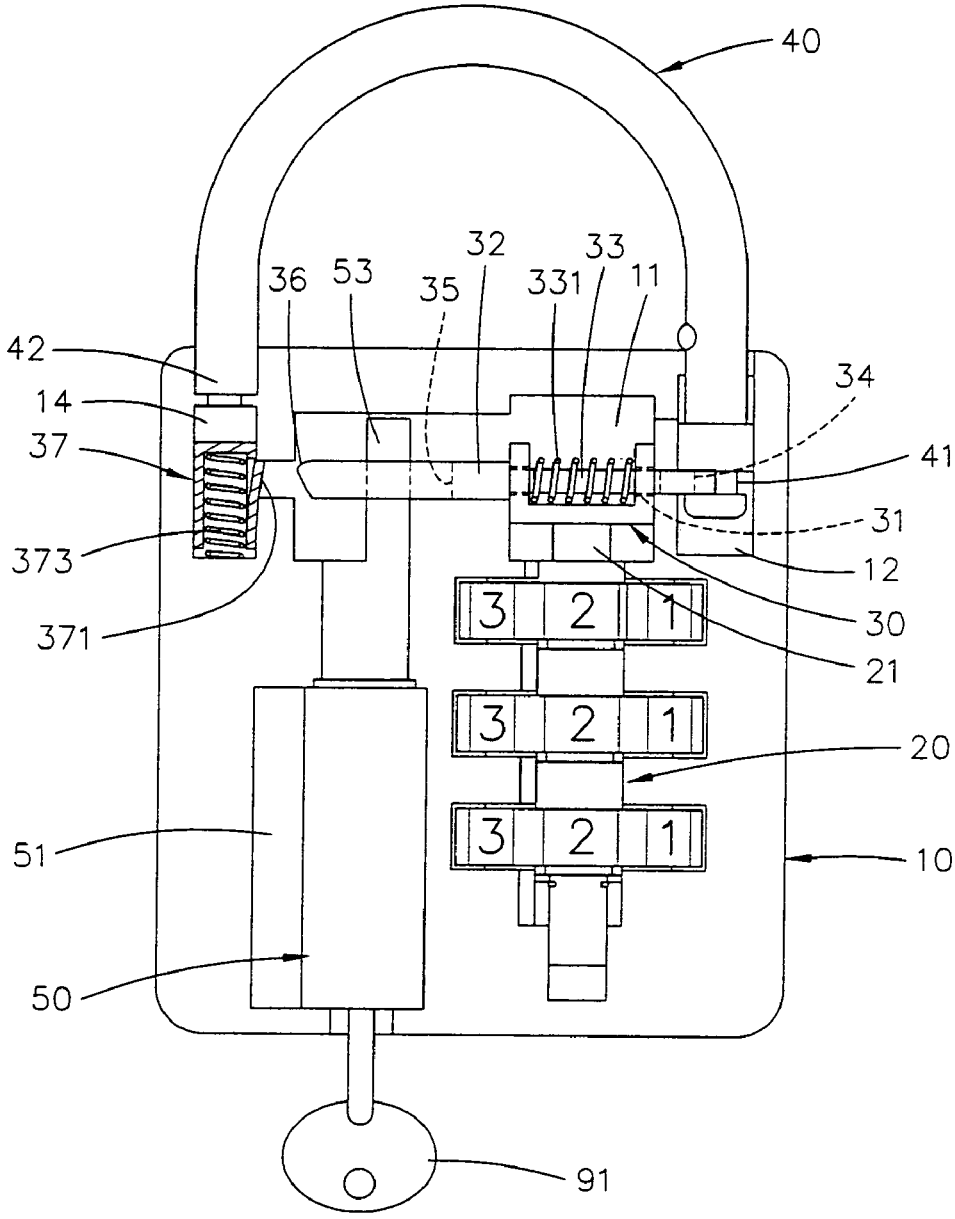
FIG. 5 is a view similar to FIG. 3, where a key is inserted into a keyhole when the combination has been forgotten or the combination has been changed by another person who shares the ownership thereof.
Figure 6:
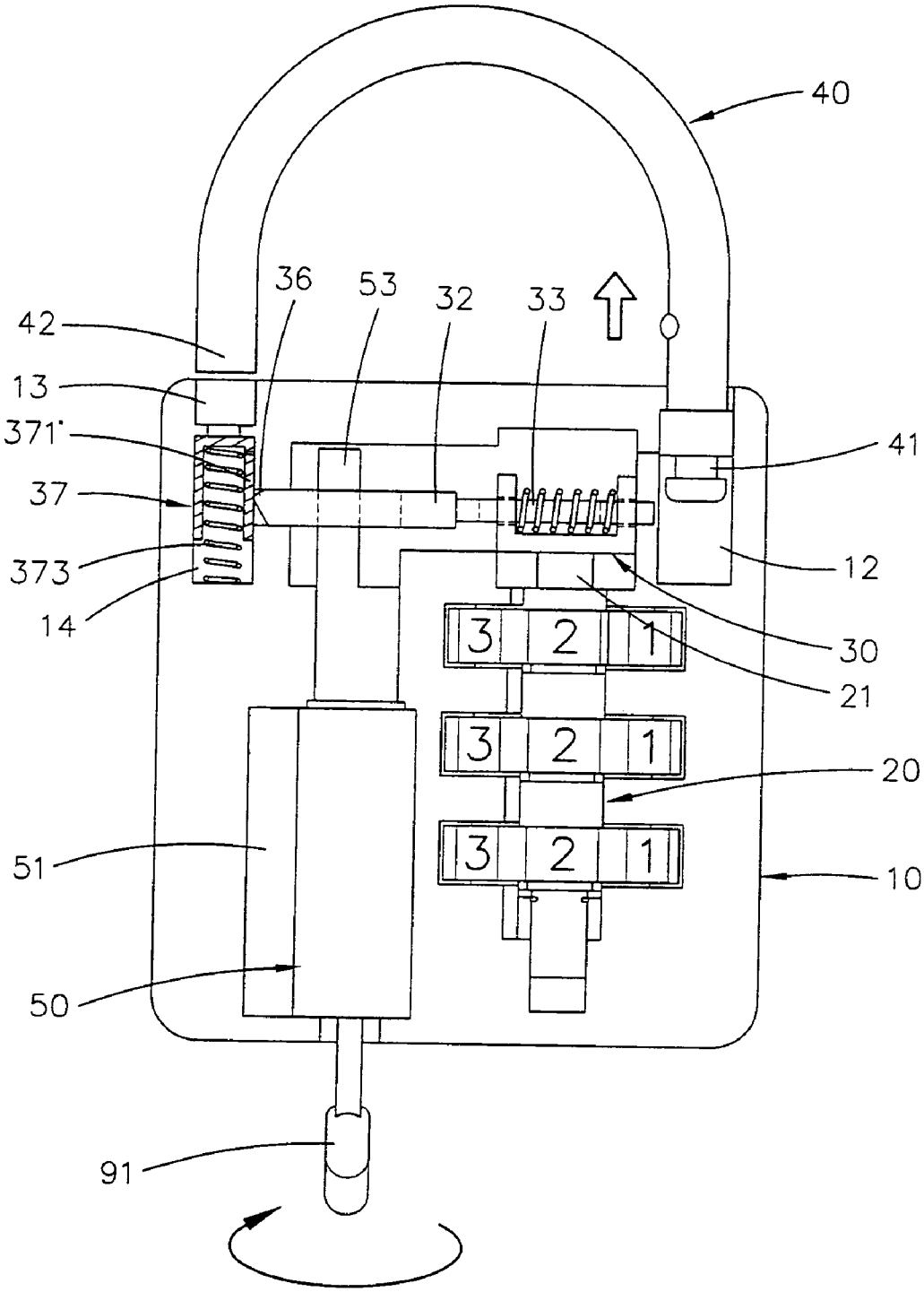
FIG. 6 is a view similar to FIG. 5, where the combination lock and padlock combination is opened by turning the key.

Referring to FIGS. 5 and 6, an operation of enabling a person to open the lock by a key either should the combination be forgotten or the combination has been changed by another person who shares the ownership of the lock will now be described in detail below. A person can insert a key 91 into the keyhole 52 to clockwise turn the key turning assembly 50 (i.e., the ridge 51 and the protrusion 53) about 180 degrees so as to move the shuttle member 32 leftward from the position shown in FIG. 5 to the position shown in FIG. 6. As a result, the projection 36 presses and flattens the latch 371 and the recess 34 clears the groove 41. The second spring 373 thus expands to push the indicator assembly 37 upward along the cavity 14 until being stopped. Thus, the person may pull the shackle 40 upward until the other leg thereof is stopped by a wall in the housing 10. At this moment, the terminating end 42 of one leg clears the second hole 13. Finally, pivot one leg of the shackle 40 about the other leg for opening the lock.

Figure 7:
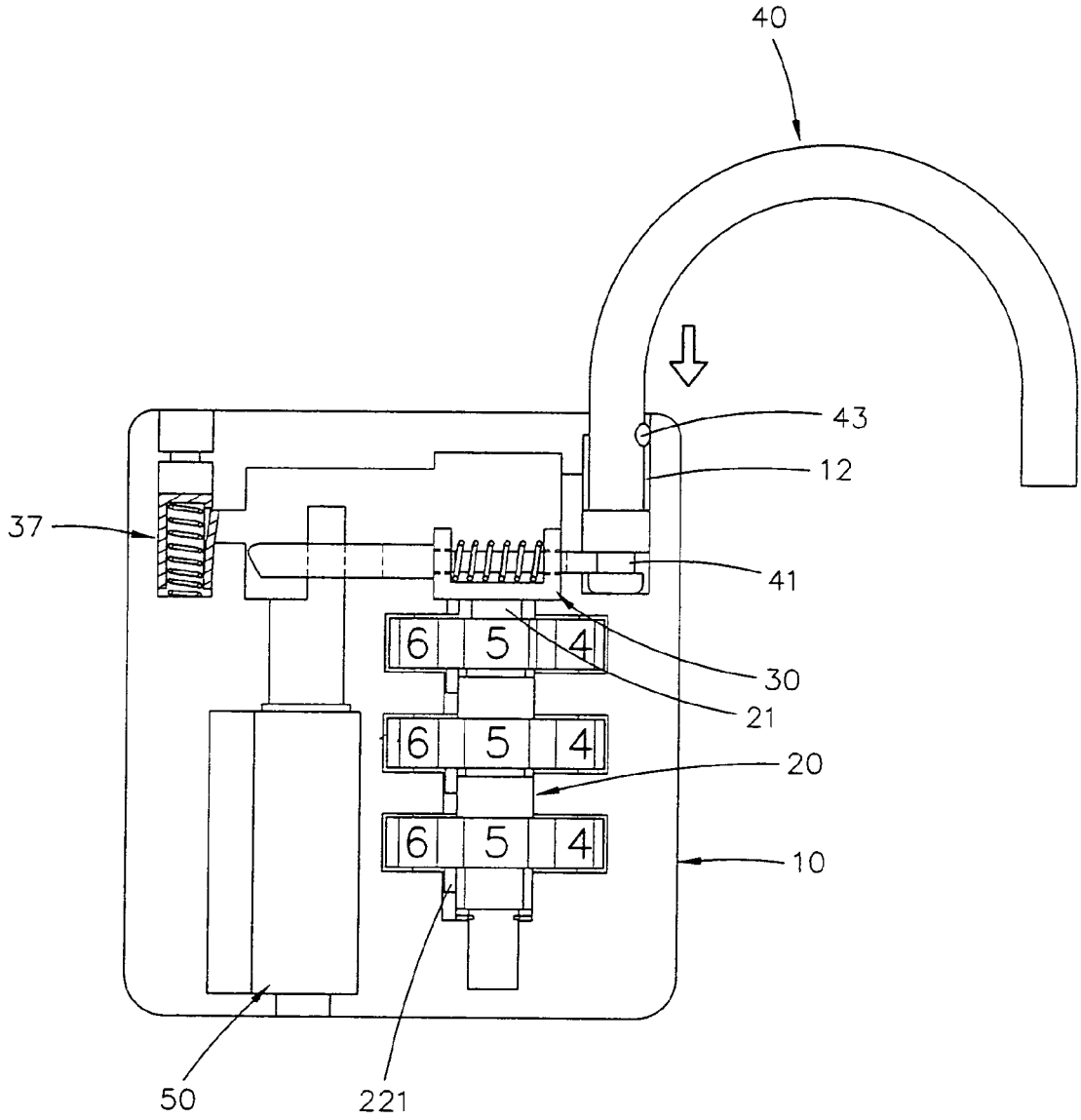
FIG. 7 is a view similar to FIG. 4 depicting a combination changing configuration of the combination lock and padlock combination.

Referring to FIG. 7, a combination changing operation of the lock is illustrated. First, turn the tumbler wheels 22 for turning the locking fins 211 the same due to the interlock engagement with the slots 221. This turning will continue until the tumbler wheels 22 has turned to a set series of numbers for opening. Next, turn one leg of the shackle 40 about its other leg about 180 degrees. Next, press the shackle 40 to move the groove 41 down along the first hole 12 due to the interlock engagement of the groove 41 and the recess 34, i.e., move the bar 21 toward a bottom of the housing 10. As such, the locking fin 211 of each section of the bar 21 disengages the corresponding slot 221. This enables a user to select any desired combination of numbers (e.g., from 2*s* to 5*s*) to represent the particular combination for opening the lock. Next, pull the shackle 40 upward to engage the locking fin 211 of each section of the bar 21 with the slot 221 different from that before the operation.

Figure 8:
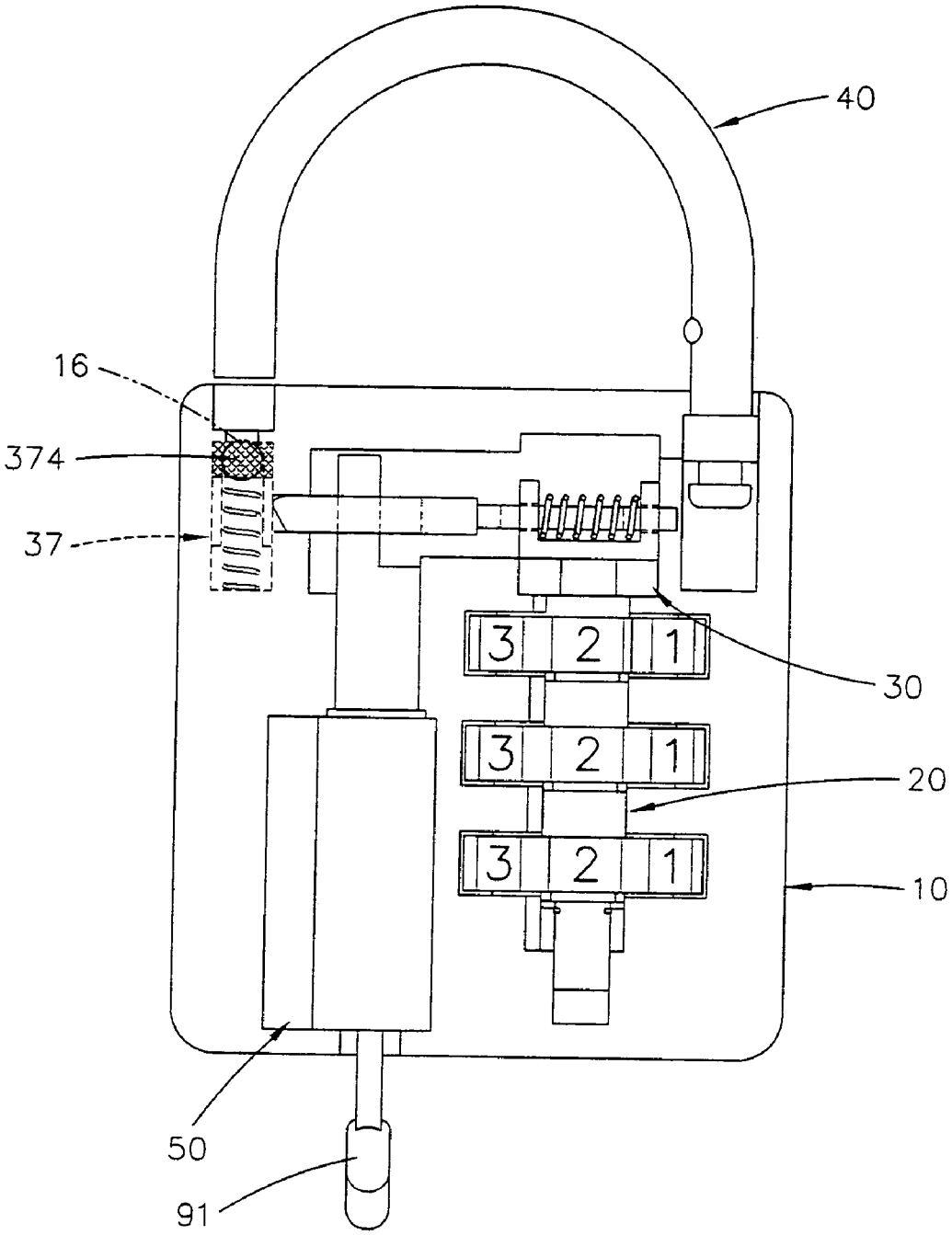
FIG. 8 is a view similar to FIG. 4, where the combination lock and padlock combination is opened by inserting a master key into the keyhole.
Figure 9:
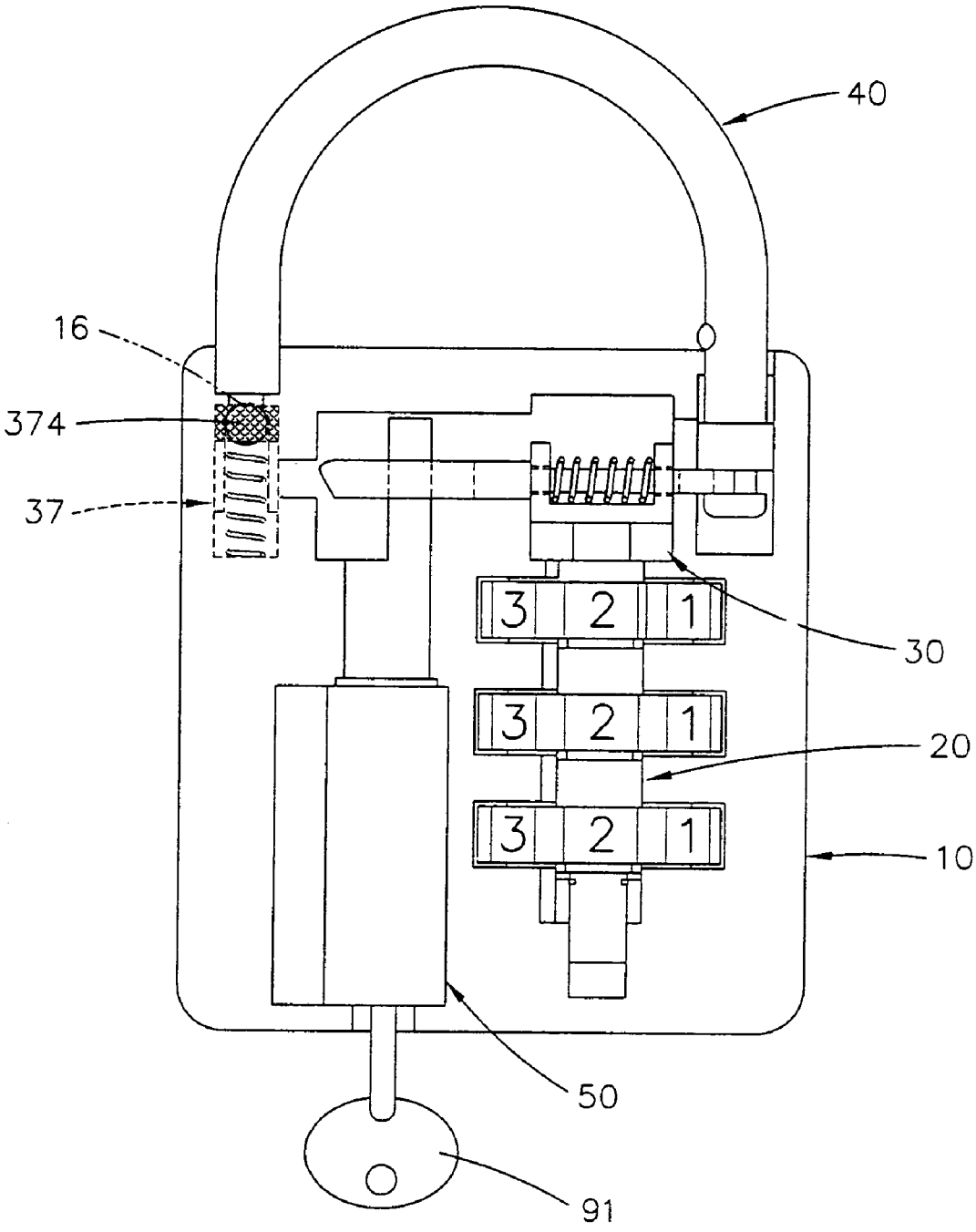
FIG. 9 is a view similar to FIG. 8, where the combination lock and padlock combination is locked with an indicating face being shown for indicating that the combination lock and padlock combination has been opened.

Referring to FIGS. 8 and 9, the characteristic described below aims at facilitating a customs officer to inspect a luggage, a container or the like and obtaining other advantages. The officer may insert a master key 91 into the keyhole 52 to clockwise turn the key turning assembly 50 (i.e., the ridge 51 and the protrusion 53) about 180 degrees so as to move the shuttle member 32 leftward from the position shown in FIG. 5 to the position shown in FIG. 6. As a result, the projection 36 presses and flattens the latch 371 and the recess 34 clears the groove 41. The second spring 373 thus expands to push the indicator assembly 37 upward along the cavity 14 until being stopped. Thus, the officer may pull the shackle 40 upward until the other leg thereof is stopped by a wall in the housing 10. At this moment, the terminating end 42 of one leg clears the second hole 13. Finally, pivot one leg of the shackle 40 about the other leg for opening the lock.

At the same time (i.e., the lock has been opened), the indicating face 374 is aligned with the window 16. Next, counterclockwise turn the key turning assembly 50 (i.e., the ridge 51 and the protrusion 53) about 180 degrees so as to move the shuttle member 32 rightward from the position shown in FIG. 6 to the position shown in FIG. 5. As a result, the projection 36 disengages the latch 371 and the recess 34 engages the groove 41. Thus, the officer may push the shackle 40 downward until the other leg thereof is stopped by a wall in the housing 10. At this moment, the terminating end 42 of one leg receives in the second hole 13. Thus, the lock is locked again. Advantageously, the indicating face 374 is still aligned with the window 16 because the second spring 373 remains in its expanding condition. Thus, another officer can know that the lock has been opened previously for inspection by viewing the indicating face 374 through the window 16. Hence, a further opening of the same is not necessary.

While the invention herein disclosed has been described by means of specific embodiments, numerous modifications and variations could be made thereto by those skilled in the art without departing from the scope and spirit of the invention set forth in the claims.

What is claimed is:

1. A combination lock and padlock combination as a lock comprising:

a housing comprising a cover including a window proximate edge and a plurality of wheel openings, and a base including a first shackle receiving hole, a second shackle receiving hole parallel and opposing the first shackle receiving hole, and a cavity proximate the second shackle receiving hole;

a tumbler wheel assembly disposed in the base and comprising a plurality of tumbler wheels each partially projected from the wheel opening and having a plurality of slots along its inner surface, a cylindrical moveable bar inserted through the tumbler wheels, the bar including a forward extension, and a plurality of lengthwise locking fins on its surface, the locking fins being aligned, snugly fitted in the slots and interlocked engaged therewith;

a locking mechanism disposed in the base and comprising a U-shaped member fixedly connected to the forward extension of the bar, the U-shaped member including two rectangular channels on both sides, a rectangular shuttle member including a central opening, a projection at one side, a spring biased extension at the other side, the extension being inserted through the channels until being stopped by a shoulder between itself and the shuttle member with the spring of the extension being biased between both sides of the U-shaped member, and an arcuate recess formed at an end of the extension, and a parallelepiped indicator assembly fitted in the cavity and including a latch at one side proximate the projection, an internal spring having one end urged against a wall of the cavity, and a knurled indicating face on its top;

a U-shaped shackle comprising one leg received in the second shackle receiving hole in a locked position, the other leg having an annular groove proximate a terminating end thereof and received in the first shackle receiving hole, the groove being in contact with the recess, and a spring depressible detent being pressed into the housing in a locked position; and a cylindrical key turning assembly disposed in the base and comprising a rectangular side ridge, a keyhole, and a forward bar-shaped protrusion having half of its forward portion being cut, the forward portion of the protrusion inserted through the central opening until a shoulder between itself and a rear portion thereof is stopped, whereby turning the tumbler wheels will turn the locking fins until a correct combination is shown on the wheel openings wherein the bar moves forward to push the U-shaped member and the shuttle member forward, and the groove moves toward a mouth of the first shackle receiving hole until being stopped with a terminating end of one leg cleared the second shackle receiving hole such that turning one leg about the other leg will open the lock; inserting a key into the keyhole to clockwise turn the key turning assembly about 180 degrees will move the shuttle member leftward for causing the projection to press and flatten the latch with the recess cleared the groove and the spring expanded to push the indicator assembly until being stopped such that pulling the shackle upward until the other leg is stopped will cause the terminating end of one leg to clear the second shackle receiving hole and pivoting one leg about the other leg will open the lock;

continuously turning the tumbler wheels until the tumbler wheels has turned to a second combination such that turning one leg about the other leg about 180 degrees, pressing the shackle to move the groove along the first shackle receiving hole and move the bar toward a bottom of the housing for disengaging the locking fins from the slots and enabling a selection of the second combination to represent the combination for opening the lock, and pulling the shackle upward to engage the locking fins with the slots different from before; and inserting a master key into the keyhole to clockwise turn the key turning assembly about 180 degrees will move the shuttle member leftward for causing the projection to press and flatten the latch with the recess cleared the groove and the spring expanded to push the indicator assembly until being stopped such that pulling the shackle upward until the other leg is stopped will cause the terminating end of one leg to clear the second shackle receiving hole, pivoting one leg about the other leg will open the lock with the indicating face aligned with the window, counterclockwise turning the key turning assembly about 180 degrees will move the shuttle member rightward for disengaging the projection from the latch and engaging the recess with the groove, pushing the shackle downward until the other leg is stopped with the terminating end of one leg received in the second shackle receiving hole and the lock locked wherein the indicating face aligned with the window is maintained so as to indicate that the lock has been opened previously by viewing the indicating face through the window.

* * * * *